United States Patent [19]

Nassry et al.

[11] 4,138,346

[45] Feb. 6, 1979

[54] WATER-BASED HYDRAULIC FLUID

[75] Inventors: Assadullah Nassry, Riverview; Jerrold F. Maxwell, Trenton, both of Mich.

[73] Assignee: BASF Wyandotte Corporation, Wyandotte, Mich.

[21] Appl. No.: 748,093

[22] Filed: Dec. 6, 1976

[51] Int. Cl.[2] ..... C10M 1/44; C10M 3/38; C09K 50/00; C05B 11/16

[52] U.S. Cl. ..... 252/32.5; 72/42; 252/45; 252/46.6; 252/46.7; 252/48.2; 252/49.5; 252/74; 252/75; 252/389 A

[58] Field of Search ..... 252/46.6, 46.7, 32.7 R, 252/32.5, 45, 47, 48.2, 74, 75, 49.5, 389 A; 72/42

[56] References Cited

U.S. PATENT DOCUMENTS 3,359,347 12/1967 Cyba ..... 252/46.7

3,933,658 1/1976 Beiswanger ..... 252/46.6

*Primary Examiner*—Delbert E. Gantz
*Assistant Examiner*—Irving Vaughn
*Attorney, Agent, or Firm*—Andrew E. Pierce; Bernhard R. Swick; Robert E. Dunn

[57] ABSTRACT

The present invention relates to the use, as hydraulic fluids or metalworking lubricants, of compositions having water as a base and improved extreme pressure lubricating and wear-preventing characteristics. The hydraulic fluids of the invention are nonflammable and comprise a synergistic combination of a phosphate ester and a sulfur-containing compound. The compositions can be thickened, if desired, using a polyglycol type thickener and can contain additives known to the art such as defoamers and corrosion inhibitors. Stable concentrates comprising the phosphate ester and sulfur-containing compound can be prepared.

7 Claims, No Drawings

WATER-BASED HYDRAULIC FLUID

BACKGROUND OF THE INVENTION

1. Field of the Invention

This invention relates to the use of lubricants, metalworking fluids and hydraulic fluids in which water is the base fluid.

2. Description of the Prior Art

In the technology of hydraulic power transmission, mechanical power is imparted to a fluid called "a hydraulic fluid" in the form of pressure by means of a hydraulic pump. Power is utilized where desired by tapping a source of said hydraulic fluid and thus transforming the power as pressure back to mechanical motion by a mechanism called a hydraulic motor. The hydraulic fluid is utilized as a pressure and volume transmitting medium. Any non-compressible fluid can perform this function. Water is the oldest fluid used for this purpose and is still sometimes used alone for this purpose. In the prior art, there has been a heavy emphasis on the development of petroleum oils for use as hydraulic fluids and consequently much of the equipment utilized with hydraulic fluids has been designed and manufactured specifically for use with petroleum oils. A petroleum oil in comparison with water as a hydraulic fluid contributes wear prevention properties and acts to inhibit the development of rust of the ferrous components of the mechanical equipment utilized in conjunction with hydraulic fluids (i.e., hydraulic pumps, motors, etc.). Petroleum oils have a second advantage over the use of water as a hydraulic fluid in that the petroleum oils normally exhibit a substantially higher viscosity than water and thus contribute to reduction of the leakage of the fluid in the mechanical equipment utilized. In addition, the technology relating to additives for petroleum oils has developed to such an extent that the viscosity, foam stability and corrosion prevention properties of such petroleum oil based hydraulic fluids can be further enhanced by the use of said additives.

Over the past 25 years, various substitutes for petroleum oil based hydraulic fluids have been developed in order to overcome one of the major deficiencies of petroleum oils, namely, flammability. Recent interest in the use of hydraulic fluids having up to 99% or more of water has resulted from the higher cost of petroleum oils and recent emphasis on problems of ecologically suitable disposal of contaminated or spent petroleum oil based hydraulic fluids.

Metalworking fluids of the so-called "soluble oil" type have been considered for use as hydraulic fluids. Such fluids contain mineral oil and emulsifiers as well as various additives to increase corrosion resistance, improve antiwear and defoaming properties. Such fluids when used as hydraulic fluids are not generally suitable for use in ordinary industrial equipment designed specifically for use with the petroleum oil based hydraulic fluids since such fluids do not adequately prevent wear damage in pumps and valves of such equipment. However, such fluids have found application in specially designed high cost, large size equipment which because of said large size and thus inflexibility is not suitable for use in most industrial plants. The soluble oil hydraulic fluid usage has thus been quite limited; usage has been largely confined to large installations where flexibility and size are not critical such as in steel mills.

It is known from ASLE transactions 7,398–405 (1964) that the phosphate esters utilized herein are useful as components of metalworking fluids in that they improve the load-carrying ability of the oil. They are also suggested for use in water-based metal-working fluids.

It is known from U.S. Pat. No. 3,933,658 to use as additives a mixture of a phosphate ester, a sulfur compound and a suitable oil-based vehicle in a water containing metalworking composition to obtain extreme pressure, antiwear and corrosion inhibiting properties. The phosphate ester and sulfur compound are used in combination with a suitable vehicle such as mineral oil, vegetable oil, fatty acid esters, etc. These compositions are used as emulsion type metalworking compositions. The phosphate ester is an ethylene oxide derivative of an alkyl or arylalkyl phosphate which can be used in the form of the free acid or in the neutralized form wherein the phosphate ester is neutralized with a metal hydroxide, ammonia or an amine. The sulfur-containing compound can be a derivative of 2-mercaptobenzothiazole. The metalworking compositions of this patent require the use of mineral oil, a glycol, a mineral oil-water mixture or a glycol-water mixture as vehicles in the preparation of the additive compositions. There is no indication that these metalworking additives would be effective without the use of said vehicles or that these metalworking additives would be effective as hydraulic fluids.

It is already known to use in equipment designed for use of mineral oil based hydraulic fluids flame-resistant glycol-water based hydraulic fluids such as are disclosed in U.S. Pat. No. 2,947,699. Up until now, water-based hydraulic fluids containing about 70 to 95 percent water have had very poor lubricating characteristics. While hydraulic fluids are used primarily to transmit forces, it is necessary that they provide lubrication for the impeller and other mechanical parts of hydraulic pumps in such systems in order to prevent excessive wear on such parts.

In the prior art, numerous hydraulic fluids have been proposed. Many of these fluids such as the petroleum oil type are highly flammable and unsuitable for certain uses where such fluids have frequently been the source of fire. Where these fluids are used to control such industrial operations as heavy casting machines, which are operated largely by hydraulic means, danger of fire exists. Therefore, there is a growing demand for nonflammable, hydraulic fluids. While the glycol-water based type fluids provide greatly improved fire resistance over the hydraulic fluids of the petroleum oil type, these fluids are not absolutely nonflammable and are otherwise objectionable. Therefore, it has become necessary to provide to the art a water-based nonflammable hydraulic fluid having satisfactory lubricating characteristics and excellent antiwear-extreme pressure performance.

SUMMARY OF THE INVENTION

A water-based hydraulic fluid or metalworking composition can be obtained by blending water and a synergistic mixture of a phosphate ester and a sulfur-containing compound and, where desirable, thickening the composition with a polyglycol type polymeric thickener to increase viscosity and improve viscosity index. Such compounds show exceptional utility as fire-retardant hydraulic fluids having excellent lubricity and antiwear characteristics. Metalworking compositions are used to cool and lubricate surfaces which are in frictional contact, such as turning, cutting, peeling, grinding and the like. The compositions of the invention provide both nonflammable hydraulic fluids and metalworking fluids which are ecologically superior to the hydraulic fluids and metalworking emulsions of the prior art containing mineral oil or a glycol mixture.

DETAILED DESCRIPTION OF THE INVENTION

In accordance with this invention, it has been found that a composition useful as a hydraulic fluid or a metalworking composition can be prepared having desirable lubricity and antiwear properties. A synergistic combination of a sulfur-containing compound and a phosphate ester in a water-base consisting of about 70 to about 95 percent and higher water in said base results quite unexpectedly in the improved properties. Desirable fluid properties, as indicated by improved antiwear characteristics and corrosion resistance properties, are obtained in the water-based hydraulic fluid or metalworking composition of the invention.

THE PHOSPHATE ESTER

The composition of the invention contains a phosphate ester selected from the group consisting of:

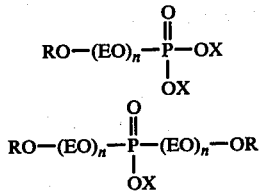

and a mixture thereof wherein EO is ethylene oxide; R is selected from the group consisting of linear or branched chain alkyl groups having about 6 to about 30 carbon atoms, preferably about 8 to about 20 carbon atoms, aryl or arylalkyl groups wherein the arylalkyl groups have about 6 to about 30 carbon atoms, preferably about 8 to about 18 carbon atoms, and X is selected from the group consisting of the residue of hydrogen, ammonia or an amine and an alkali or alkaline earth metal or mixtures thereof and n is a number from 1–50. Metals such as lithium, sodium, potassium, rubidium, cesium, calcium, strontium and barium are examples of X.

The phosphate ester compositions utilized in the compositions of the invention are more fully disclosed in U.S. Pat. Nos. 3,004,056 and 3,004,057.

In general, the phosphate esters employed are obtained by esterifying one mole of $P_2O_5$ with 2 to 4.5 moles of a nonionic surface active agent characterized as a condensation product of at least one mole of ethylene oxide with one mole of a compound having at least 6 carbon atoms and a reactive hydrogen atom. Such nonionic surface active agents are well known in the art and are generally prepared by condensing a polyglycol ether containing a suitable number of alkenoxy groups or a 1,2-alkylene oxide, or substituted alkylene oxide such as a substituted propylene oxide, butylene oxide or preferably ethylene oxide with an organic compound containing at least 6 carbon atoms and a reactive hydrogen atom. Examples of compounds containing a reactive hydrogen atom are alcohols, phenols, thiols, primary and secondary amines, and carboxylic and sulfonic acids and their amides. The amount of alkylene oxide or equivalent condensed with the reactive chain will depend primarily upon the particular compound with which it is condensed. Generally, an amount of alkylene oxide or equivalent should be employed which will result in a condensation product containing about 20 to 85 percent by weight of combined alkylene oxide. However, the optimum amount of alkylene oxide for attainment of the desired hydrophobic-hydrophilic balance may be readily determined in any particular case by preliminary test and routine experimentation.

The nonionic surface active agents used are preferably polyoxyalkylene derivatives of alkylated and polyalkylated phenols, multi-branched chain primary aliphatic alcohols having the molecular configuration of an alcohol produced by the Oxo process from a polyolefin of at least 7 carbon atoms, and straight chain aliphatic alcohols of at least 10 carbon atoms. Examples of these derivatives and other suitable nonionic surface active agents which may be phosphated in accordance with the present invention are included below. In this list, "E.O" means "ethylene oxide" and the number preceding same refers to the number of moles thereof reacted with one mole of the given reactive hydrogen-containing compound.

Nonylphenol + 9 - 11 E.O.
Nonylphenol + 2 E.O.
Dinonylphenol + 7 E.O.
Dodecylphenol + 18 E.O.
Castor oil + 20 E.O.
Tall oil + 18 E.O.
Oleyl alcohol + 4 E.O.
Oleyl alcohol + 20 E.O.
Lauryl alcohol + 4 E.O.
Lauryl alcohol + 15 E.O.
Hexadecyl alcohol + 12 E.O.
Hexadecyl alcohol + 20 E.O.
Octadecyl alcohol + 20 E.O.
Oxo tridecyl alcohol:
(From tetrapropylene) + 7 E.O.
(From tetrapropylene) + 10 E.O.
(From tetrapropylene) + 15 E.O.
Dodecyl mercaptan + 9 E.O.
Soya bean oil amine + 10 E.O.
Rosin amine + 32 E.O.
Coconut fatty acid amine + 7 E.O.
Cocoa fatty acid + 10 E.O.
Dodecylbenzene sulfonamide + 10 E.O.
Decyl sulfonamide + 6 E.O.
Oleic acid + 5 E.O.
Polypropylene glycol (30 oxypropylene units) + 10 E.O.

Advantageous properties are contributed by the phosphate ester component of the hydraulic fluid or metalworking composition of the invention, specifically the phosphorus element. It is known that such element can contribute to the antiwear and extreme pressure performance of a lubricant composition. The lubricity which is required in such compositions is believed to be contributed by the arylalkyl or alkyl polyethoxyethylene moieties.

A proper balance of hydrophilic/lipophilic properties is contributed by ethoxylation so as to obtain the necessary water solubility for such compounds in addition to lubricity, antifriction, antiwear and corrosion inhibiting properties. The aqueous solutions of these phosphate esters are completely stable under neutral and extreme alkaline conditions and show little tendency to hydrolyze on storage.

Stable concentrates of the hydraulic fluids and metalworking fluids of the invention can also be prepared. These can be made up completely free of water or contain up to 20 percent by weight of water to increase fluidity and provide ease of blending at the point of use.

Representative concentrates are as follows:

Table I

| Hydraulic Fluid Concentrates | | | | | | | | |
|---|---|---|---|---|---|---|---|---|
| Ingredient | Percent (by weight) | | | | | | | |
| Phosphate ester of the invention | 50 | 75 | 25 | 40 | 60 | 20 | 25 | 20 |
| Sulfur compound of the invention | 50 | 25 | 75 | 40 | 20 | 60 | 25 | 20 |
| Corrosion inhibitor (i.e. morpholine) | — | — | — | — | — | — | 50 | 40 |
| Water | — | — | — | 20 | 20 | 20 | — | — |

The proportion of phosphate ester to sulfur-containing compound is about 25:1 to about 1:1, preferably about 10:1 to about 1:1 by weight based upon the weight of the sulfur in the sulfur-containing compound. The amount of sulfur-containing compound and phosphate ester present based on the total weight of the hydraulic fluid or metalworking compositions of the invention as used is about 0.05 percent to about 3 percent by weight for the sulfur-containing compound and about 0.05 to about 6 percent by weight for the phosphate ester. Additives can be added to the concentrate or diluted concentrate such as thickeners, amine type vapor phase corrosion inhibitors, alkali metal nitrites, etc.

THE SULFUR COMPOUNDS

The sulfur-containing compound useful in the compositions of the invention can be at least one of the ammonia, amine or metal salts of 2-mercaptobenzothiazole or 5-, 6- and 7-substituted 2-mercaptobenzothiazole, said salts being formed upon neutralization of the free acid form of 2-mercaptobenzothiazole of the formula:

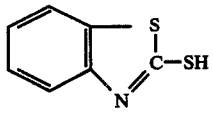

with a base. Ammonia or an amine or an alkali or alkaline earth metal hydroxide or carbonate are suitable bases for the formation of said salts wherein said metal is selected from groups I-A and II-A of the periodic table. Representative substituted compounds are selected from the group consisting of the chloro, bromo, sulfonic acid, amido, methyl, carboxylic acid and ethoxy substituted compounds. Examples of such substituted compounds are the following:

5-chloro-2-mercaptobenzothiazole,
5-bromo-2-mercaptobenzothiazole,
5-sulfonic acid-2-mercaptobenzothiazole,
5-amido-2-mercaptobenzothiazole,
5-methyl-2-mercaptobenzothiazole,
7-methyl-2-mercaptobenzothiazole,
5-carboxylic acid-2-mercaptobenzothiazole,
5-ethoxy-2-mercaptobenzothiazole,
6-ethoxy-2-mercaptobenzothiazole,
6-chloro-2-mercaptobenzothiazole, etc.

Other sulfur-containing compounds can be used in the hydraulic fluid compositions of the invention. These are the ammonia, amine or alkali or alkaline earth metal salts as formed by neutralization with a base of the free acid form derivatives of 2-mercaptothiazole having the formula:

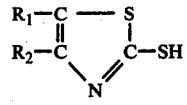

wherein said metals are selected from Groups I-A and II-A of the periodic table; $R_1$ is selected from the group consisting of hydrogen and an alkyl group having from 1 to 10 carbon atoms; $R_2$ is selected from the group consisting of hydrogen and an alkyl group having from 1 to 10 carbon atoms, carboxy,

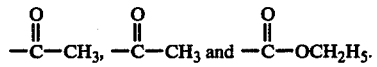

Also useful are the 2,2'-dithiobis (thiazole) derivatives of 2-mercaptobenzothiazole having the following formula:

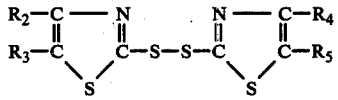

wherein $R_2$, $R_3$, $R_4$ and $R_5$ are selected from hydrogen and an alkyl group having from 1 to 10 carbon atoms; 2,2'-dithiobis(benzothiazole) and derivatives thereof such as 5,5'-dichloro-2,2'-dithiobis(benzothiazole), 5,5'-dibromo-2,2'-dithiobis(benzothiazole), 5,5'-disulfonic acid(sodium salt)-2,2'-dithiobis(benzothiazole), 5,5'-diamido-2,2'-dithiobis(benzothiazole), 5,5'-dimethyl-2,2'-dithiobis(benzothiazole), 7,7'-dimethyl-2,2'-dithiobis(benzothiazole), 5,5'-dicarboxylic acid-2,2'-dithiobis(benzothiazole), 5,5'-diethoxy-2,2'-dithiobis(benzothiazole), 6,6'-diethoxy-2,2'-dithiobis(benzothiazole), etc.; polysulfides of the 2-mercaptobenzothiazole compounds listed above; 2-mercaptonapthothiazole; 2,2'-dithiobis (naphthothiazole) and polysulfides of 2-mercaptonaphthothiazole and derivatives of these compounds analogous to the 2-mercaptobenzothiazole derivatives listed above; diphenyl sulfide and analogues such as di-n-butyl sulphide, di-sec-butyl sulphide, di-tert-butyl sulphide, dibenzyl sulphide, etc.; diphenyl disulfide with analogues such as di-n-butyl disulphide, di-sec-butyl disulphide, di-tert-butyl disulphide, dibenzyl disulphide, di-octyl disulphide, di-allyl disulphide, di-n-dodecyldisulphide, etc.; and various sulfones such as di-tert-butyl sulfone.

While the phosphate ester and sulfur-containing compound of the invention contribute corrosion resistance properties to the compositions of the invention, it is desirable to include in the compositions of the invention additional known corrosion inhibitors of the prior art, namely, amines, nitrites, and alkoxylated fatty acids. Useful amines are the aliphatic, cycloaliphatic and aromatic amines as illustrated by those listed below. Useful nitrites are the alkali metal or alkaline earth metal nitrites such as sodium nitrite, potassium nitrate, barium nitrite and strontium nitrite. Useful alkoxylated fatty acids are alkoxylated oleic acid, alkoxylated stearic acid, and alkoxylated palmitic acid; useful alkoxylated dimer acids are oleic dimer acid and stearic dimer acid.

Useful amines include the aliphatic, heterocyclic, and aromatic amines including the alkanolamines. Representative examples are as follows: butylamine, propylamine, n-octylamine, hexylamine, morpholine, N-ethyl morpholine, N-methyl morpholine, aniline, triphenylamine, aminotoluene, ethylene diamine, dimethylaminopropylamine, N,N-dimethyl ethanolamine, triethanolamine, diethanolamine, monoethanolamine, 2-methyl pyridine, 4-methyl pyridine, piperazine, dimethyl morpholine and methoxypropylamine. A preferred vapor-phase corrosion inhibiting compound is morpholine. The corrosion inhibitors are used in the proportion of about 0.05 to about 2 percent by weight, preferably about 0.5 to about 1 percent by weight on the basis of the total weight of the hydraulic fluid or metalworking composition of the invention.

It is generally desirable to utilize in the hydraulic fluid composition of the invention a thickener. Generally about 3 to about 20 percent by weight, preferably about 5 to about 15 percent by weight of thickener is used. Preferably the thickener is of the polyglycol type, the use of which results both in an increase in viscosity and improved viscosity index of the composition. It has been found that this type of thickener has particular advantages from the standpoint of providing Newtonian Viscosity characteristics and stability of the thickening effect under varying conditions of shear during pumping of the hydraulic fluid composition of the invention and is the preferred thickener of the invention. Generally, such thickeners are polyoxyalkylene polyols containing ethylene oxide and propylene oxide in an oxide ratio of between about 100:0 to about 70:30 ethylene oxide-propylene oxide. The thickeners are commercially available and sold under the trade mark "Ucon 75H-90,000" by Union Carbide and Carbon Chemical Corporation. This material has a pour point of 40° F., a flash point of 485° F., a specific gravity at 20° centigrade of 1.095, and a viscosity of about 90,000 S.U.S. at 100° F. By the use of such thickeners (and others such as those based upon polyvinyl alcohol and polyacrylates) in the hydraulic fluids of the invention, it is believed that wear resulting from cavitation as well as internal and external leakage during the pumping of such hydraulic fluids can be avoided to a substantial extent.

It is a feature of the instant invention that the components utilized are all capable of being colloidially dispersed in water as contrasted with those prior art metalworking fluid additives which are insoluble and require emulsification in water prior to use. It is believed that one explanation for the improved lubricating and antiwear properties of the compositions of the invention is the fact that the additives used are in the form of colloidal dispersions rather than merely dispersible by emulsification.

In evaluating the hydraulic fluids of the invention, a test generally referred to as the Vickers Vane Pump Test is employed. The apparatus used in this test is a hydraulic system which functions as follows: Hydraulic fluid is drawn from a closed sump to the intake side of a Vickers V-104E vane-type pump. The pump is driven by, and directly coupled to, a twenty-five horsepower, 1740 r.p.m. electric motor. The fluid is discharged from the pump through a pressure regulating valve. From there it passes through a calibrated venturi (used to measure flow rate) and back to the sump. Cooling of the fluid is accomplished by a heat exchanger through which cold water is circulated. No external heat is required; the fluid temperature being raised by the frictional heat resulting from the pump's work on the fluid. Excess heat is removed by passing the fluid through the heat exchanger prior to return on the sump. The Vickers V-104E vane-type pump comprises a cylindrical enclosure in which there is housed a so-called "pump cartridge". The "pump cartridge" assembly consists of front and rear circular, bronze bushings, a rotor, a cam-ring and rectangular vanes. The bushings and cam-ring are supported by the body of the pump and the rotor is connected to a shaft which is turned by an electric motor. A plurality of removable vanes are inserted into slots in the periphery of the rotor. The cam-ring encircles the rotor and the rotor and vanes are enclosed by the cam-ring and the bushings. The inner surface of the cam-ring is cam shaped. Rotating the rotor results in a change in displacement of each cavity enclosed by the rotor, the cam-ring, two adjacent vanes and the bushings. The body is ported to allow fluid to enter and leave the cavity as rotation occurs.

The Vickers Vane Pump Test procedure used specifically requires charging the system with five gallons of the test fluid and running at temperatures ranging from 100° to 135° F. at 1000 p.s.i. pump discharge pressure (load). Wear data were made by weighing the ring and the vanes of the "pump cartridge" before and after the test. At the conclusion of the test run and upon disassembly for weighing, visual examination of the system was made for signs of deposits, varnish, corrosion, etc.

The following examples more fully describe the hydraulic fluids of the invention and show the unexpected results obtained by their use. The examples are intended for the purpose of illustration and are not to be construed as limiting in any way. All parts and percentages are by weight and all temperatures are in degrees centigrade unless otherwise noted.

EXAMPLE 1

A hydraulic fluid was prepared by blending 83.6 parts water, 1.0 part morpholine, 0.5 parts phosphate ester, 0.25 parts potassium 2-mercaptobenzothiazole, and 14.2 parts of a polyglycol thickener having a viscosity of 95,000 S.U.S. at 100° F. Such thickening materials are available commercially and are made by copolymerizing about 70 mole percent of ethylene oxide with about 30 mole percent of propylene oxide to obtain a product sufficiently high in molecular weight so as to act as a thickener. The phosphate ester utilized is produced by the reaction of 1 mole of $P_2O_5$ with a condensation product of one mole of oleyl alcohol and 4 moles of ethylene oxide in accordance with the methods disclosed in U.S. Pat. Nos. 3,004,056 and 3,004,057. A clear to slightly hazy, free-flowing water-based hydraulic fluid is obtained which is stable to storage at room temperature.

EXAMPLE 2

Using the same procedure and proportions of ingredients as in Example 1 except as follows, a hydraulic fluid was prepared using 0.38 parts potassium 2-mercaptobenzothiazole.

EXAMPLE 3

Using the same procedure and proportions as in Example 1 except as follows, a hydraulic fluid was prepared omitting potassium 2-mercaptobenzothiazole.

Using the hydraulic fluid compositions, as described in Examples 1, 2 and 3, Vickers vane pump wear tests were performed. The results are described in Table II.

Table II

VICKERS VANE PUMP WEAR TESTS AT 100° F. AND 1000 PSI LOAD

| Example No. | Ratio Phosphate Ester Sulfur Compound | Run Time (hours) | Wear (mg) Cam Ring | Vanes | Total |
|---|---|---|---|---|---|
| 1 | 2/1 | 20 | 470 | 2 | 472 |
| 2 | 2/1.5 | 20 | 589 | 1 | 590 |
| 3 | 2/0 | 20 | 670 | 4 | 674 |

EXAMPLES 4–13

Hydraulic fluids were prepared by blending indicated proportions of various phosphate esters prepared by esterifying one mole of $P_2O_5$ with various amounts as indicated by molar ratio of the surface active agent condensation products indicated in the table below with the potassium salt of 2-mercaptobenzothiazole (Examples 4–8) and the same proportions of water, thickener and morpholine used in Example 1. These fluids were evaluated using the well accepted Shell 4-ball test and results are shown in Table III below. Comparison with similar fluids prepared omitting the potassium salt of 2-mercaptobenzothiazole (Examples 9–13) shows no indication of synergism and in fact, a general trend toward reduced wear in the examples in which the potassium salt of 2-mercaptobenzothiazole is omitted from the hydraulic fluid. It is therefore unexpected that the Vickers vane pump test results shown in Table II above, indicate a synergistic improvement in wear reduction where the phosphate ester of the invention is combined with the sulfur-containing compound of the invention.

TABLE III

ANTIWEAR PERFORMANCE OF VARIOUS PHOSPHATE ESTERS IN COMBINATION WITH AND WITHOUT K-2-MBT (POTASSIUM-2-MERCAPTOBENZOTHIAZOLE) IN A BASE-STOCK HIGH WATER CONTENT HYDRAULIC FLUID IN THE SHELL FOUR-BALL TEST*

| Example No. | Phosphate Esters | Molar Ratio, Agent:$P_2O_5$ | 0.50% P/E With 0.25% K-2-MBT Scar Diameters, mm 30 Minutes 7.5 Kg | 40 Kg | 0.50% P/E Without K-2-MBT Scar Diameters, mm 30 Minutes 7.5 Kg | 40 Kg |
|---|---|---|---|---|---|---|
| 4 | Dinonylphenol + 7.0 Moles EO | 2.7:1 | 0.611 | 0.775 | | |
| 5 | Nonylphenol + 4.0 Moles EO | 4:1 | 0.627 | 0.735 | | |
| 6 | Phenol + .0 Moles EO | 4:1 | 0.914 | 0.927 | | |
| 7 | Tridecyl Alcohol + 10.0 Moles EO | 2.7:1 | 0.666 | 0.748 | | |
| 8 | Oleyl Alcohol + 4.0 Moles EO | 2:1 | 0.720 | 0.752 | | |
| 9 | Dinonylphenol + 7.0 Moles EO | 2.7:1 | | | 0.588 | 0.610 |
| 10 | Nonylphenol + 4.0 Moles EO | 4:1 | | | 0.590 | 0.611 |
| 11 | Phenol + 6.0 Moles EO | 4:1 | | | 0.758 | 0.899 |
| 12 | Tridecyl Alcohol + 10.0 Moles EO | 2.7:1 | | | 0.638 | 0.923 |
| 13 | Oleyl Alcohol + 4.0 Moles EO | 2:1 | | | 0.604 | 0.622 |

*52100 Steel Balls, 1800 rpm, room temperature, 30 minutes running times

While this invention has been described with reference to certain specific embodiments, it will be recognized by those skilled in the art that many variations are possible without departing from the scope and spirit of the invention.

The embodiments of the invention in which an exclusive property or privilege is claimed are defined as follows:

1. A composition useful as a hydraulic fluid, lubricant and corrosion inhibitor consisting essentially of water, as a base, and minor effective amounts of:

(A) a phosphate ester selected from the group consisting of

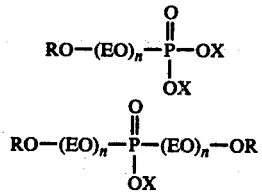

and mixtures thereof wherein EO is ethylene oxide; R is selected from the group consisting of linear or branched chain alkyl groups having about 6 to about 30 carbon atoms, and aryl or arylalkyl groups wherein the arylalkyl groups have about 6 to about 30 carbon atoms; X is selected from the group consisting of the residue of hydrogen, ammonia, an amine, an alkali or alkaline earth metal and mixtures thereof; n is a number from 1–50 and (B) at least one sulfur-containing compound selected from the group consisting of (1) the ammonia, amine or metal salts of 5,6 and 7 substituted 2-mercaptobenzothiazole wherein the substituent is selected from the group consisting of chloro, bromo, sulfonic acid, amido, methyl, carboxylic acid and ethoxy;

(2) the ammonia, amine or metal salt derivatives of 2-mercaptobenzothiazole derived from the free acid of the formula:

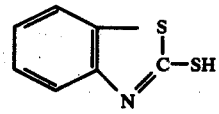

(3) the ammonia, amine or metal salts of derivatives of 2-mercaptothiazole derived from the free acid of the formula:

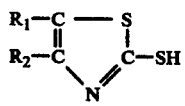

wherein said salts are formed by neutralization of said free acid with ammonia, an amine, an alkali or alkaline earth metal hydroxide or carbonate wherein said metal is selected from the groups 1-A and II-A of the periodic table; wherein $R_1$ and $R_2$ are selected from the group consisting of hydrogen and alkyl group of 1 to 10 carbon atoms;

(4) 2,2'-dithiobisthiazole and derivatives thereof of the formula:

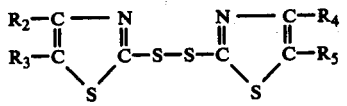

wherein $R_2$, $R_3$, $R_4$ and $R_5$ are selected from the group consisting of hydrogen and an alkyl group having from 1 to 10 carbon atoms;

(5) 2,2'-dithiobis(benzothiazole) and 5,5',6,6'and 7,7'substituted derivatives thereof; wherein the substituent is selected from the group consisting of dichloro, dibromo, disulfonic acid, diamido, dimethyl, dicarboxylic acid, and diethoxy;

(6) 2-mercaptonaphthothiazole;

(7) 2,2'-dithiobis(naphthothiazole);

(8) diphenyl sulfide;

(9) diphenyl disulfide;

(10) di-tert-butyl disulfide; and

(11) ditertiary butyl sulfone; the weight ratio of said phosphate ester to said sulfur-containing compound being in the range of from about 25:1 to about 1:1 based upon the weight of sulfur in the sulfur-containing compound.

2. The composition of claim 1 wherein said phosphate ester is the ester of 1 mole of phosphorus pentoxide and 2 moles of the condensation product of one mole of oleyl alcohol and four moles of ethylene oxide and said sulfur compound is potassium 2-mercaptobenzothiazole.

3. The composition of claim 1 wherein the ratio of phosphate ester to sulfur-containing compound is about 10:1 to about 1:1 by weight based upon the weight of the sulfur in the sulfur-containing compound and wherein R is selected from the group consisting of a linear alkyl group and an arylalkyl group and n is a number from 1 to 10.

4. The composition of claim 3 in which said sulfur-containing compound is potassium 2-mercaptobenzothiazole.

5. The composition of claim 2 wherein said 5,6 and 7 substituted 2-mercaptobenzothiazole has a substituent selected from the group consisting of chloro, bromo, sulfonic acid, amido, methyl, carboxylic acid, and ethoxy.

6. The composition of claim 2 wherein the amount of sulfur-containing compound and phosphate ester present based upon the total weight of said hydraulic fluid is about 0.05% to about 3% by weight for the sulfur-containing compound and about 0.05% to about 6% by weight for the phosphate ester.

7. A method of lubricating comprising the step of applying to elements to be lubricated a liquid, water based lubricating composition consisting essentially of water, an effective amount of a phosphate ester selected from the group consisting of:

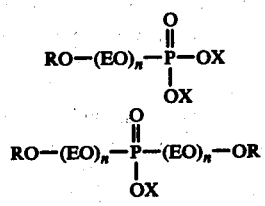

and mixtures thereof wherein EO is ethylene oxide; X is selected from the group consisting of hydrogen, the residue of ammonia or an amine, an alkali or alkaline earth metal and mixtures thereof; R is selected from the group consisting of linear or branched chain alkyl groups having about 6 to about 30 carbon atoms and aryl or arylalkyl groups wherein the alkyl groups have about 6 to about 30 carbon atoms, and n is a number from 1–50; an effective amount of an ammonia, amine, alkali metal or alkaline earth metal salt of 2-mercaptobenzothiazole and a corrosion inhibiting amount of morpholine.

* * * * *